US008238766B2

(12) United States Patent
Okano

(10) Patent No.: US 8,238,766 B2
(45) Date of Patent: Aug. 7, 2012

(54) IMAGE FORMING APPARATUS FOR PRINTING ON SHEETS FED FROM A STACKING UNIT AND A MANUAL FEED SLOT

(75) Inventor: Tetsuya Okano, Anjo (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 388 days.

(21) Appl. No.: 12/510,317

(22) Filed: Jul. 28, 2009

(65) Prior Publication Data

US 2010/0021185 A1 Jan. 28, 2010

(30) Foreign Application Priority Data

Jul. 28, 2008 (JP) ..... 2008-194008

(51) Int. Cl.

| | |
|---|---|
| ***G03G 15/00*** | (2006.01) |
| ***B65H 3/44*** | (2006.01) |
| ***B65H 5/26*** | (2006.01) |
| ***B65H 7/02*** | (2006.01) |

(52) U.S. Cl. ..... 399/16; 399/18; 399/19; 399/21; 399/391; 399/392; 271/9.09; 271/9.13; 271/258.01; 271/265.02

(58) Field of Classification Search ..... 399/16, 399/18, 19, 21, 23, 391, 392; 271/9.02, 9.09, 271/9.13, 256, 258.01, 262, 265.02
See application file for complete search history.

(56) References Cited

U.S. PATENT DOCUMENTS

| | | | | |
|---|---|---|---|---|
| 4,796,055 | A * | 1/1989 | Takano et al. | 399/20 |
| 5,651,538 | A | 7/1997 | Chung et al. | |
| 6,959,155 | B2 * | 10/2005 | Kim | 399/21 |
| 7,366,459 | B2 | 4/2008 | Nishimura | |
| 2003/0118385 | A1 | 6/2003 | Isemura et al. | |
| 2008/0067732 | A1 | 3/2008 | Matsushima | |
| 2008/0075489 | A1 * | 3/2008 | Hayashi | 399/45 |

FOREIGN PATENT DOCUMENTS

JP 52-166542 U 12/1977

(Continued)

OTHER PUBLICATIONS

JP Office Action dtd Apr. 20, 2010, JP Appln. 2008-194008, English translation.

*Primary Examiner* — Judy Nguyen
*Assistant Examiner* — Justin Olamit
(74) *Attorney, Agent, or Firm* — Banner & Witcoff, Ltd.

(57) ABSTRACT

An image forming apparatus includes an image forming unit; a transport roller transporting the sheet to the image forming unit; a stacking unit stacking a sheet; a manual feed path extending from a manual feed slot to the transport roller; a feed path extending from the stacking unit to the transport roller; a feed unit transporting the sheet of the stacking unit to the transport roller through the feed path; a first detection unit detecting a sheet inserted into the manual feed path from the manual feed slot; and a control unit, when the first detection unit detects the sheet inserted from the manual feed slot while an operation to feed the sheet of the stacking unit to the image forming unit by the feed unit and the transport roller, and an image forming operation by the image forming unit are executed, aborting the image forming operation.

13 Claims, 14 Drawing Sheets

FOREIGN PATENT DOCUMENTS

| | | | |
|---|---|---|---|
| JP | 5-027491 | A | 2/1993 |
| JP | 8-224924 | A | 9/1996 |
| JP | 2001-235980 | | 8/2001 |
| JP | 2003-237981 | A | 8/2003 |
| JP | 2005-195698 | | 7/2005 |
| JP | 2006-062816 | | 3/2006 |
| JP | 2006-160431 | | 6/2006 |
| JP | 2008-074533 | | 4/2008 |

* cited by examiner

IMAGE FORMING APPARATUS FOR PRINTING ON SHEETS FED FROM A STACKING UNIT AND A MANUAL FEED SLOT

CROSS REFERENCE TO RELATED APPLICATION

The present application claims priority from Japanese Patent Application No. 2008-194008, which was filed on Jul. 28, 2008, the disclosure of which is herein incorporated by reference in its entirety.

TECHNICAL FIELD

The present invention relates to an image forming apparatus, and in particular, to an image forming apparatus in which recording mediums can be fed from both a stacking unit and a manual feed slot.

BACKGROUND

An image forming apparatus is known which has a tray print function to perform printing on sheets (recording mediums) stacked in a sheet feed tray (stacking unit), and a manual print function to perform printing on sheets inserted from a manual feed slot by a user. For example, in the above described image forming apparatus, a transport path of a sheet from the manual feed slot and a transport of a sheet from the sheet feed tray are joined together before a registration roller, and continue on downstream to the image forming unit on the downstream side. In such an image forming apparatus, for example, when a print operation starts, it is detected whether or not a sheet is inserted from the manual feed slot, and when a sheet is detected, the sheet is fed to the image forming unit, and print is performed. Meanwhile, when a sheet from the manual feed slot is not detected, a sheet from the sheet feed tray is fed to the image forming unit, and print is performed.

SUMMARY

However, a user may insert a sheet into the manual feed slot with arbitrary timing. For this reason, if a sheet is inserted from the manual feed slot while a sheet from the tray is being transported, both sheets are transported in a stacked state, and one image may be printed over two sheets or a severe jam may occur.

The invention has been finalized in consideration of the above-described situation, and it is an aspect of the invention to provide an image forming apparatus that is capable of suppressing the occurrence of trouble when another recording medium is inserted from a manual feed slot while a recording medium is being fed from a stacking unit.

Exemplary embodiments of the present invention address the above disadvantages and other disadvantages not described above. However, the present invention is not required to overcome the disadvantages described above, and thus, an exemplary embodiment of the present invention may not overcome any of the problems described above.

According to an illustrative aspect of the present invention, there is provided an image forming apparatus comprising: an image forming unit that forms an image on a recording medium; a transport roller that transports a recording medium to the image forming unit; a stacking unit that stacks a recording medium; a manual feed path that extends from a manual feed slot to the transport roller; a feed path that extends from the stacking unit to the transport roller; a feed unit that transports the recording medium stacked in the stacking unit to the transport roller through the feed path; a first detection unit that detects a recording medium inserted into the manual feed path from the manual feed slot; and a control unit, when the first detection unit detects the recording medium inserted from the manual feed slot while an operation to feed the recording medium of the stacking unit to the image forming unit by the feed unit and the transport roller, and an image forming operation by the image forming unit are executed, that is configured to abort the image forming operation by the image forming unit.

According to the aspect of the invention, when a recording medium is inserted from the manual feed slot while a recording medium of the stacking unit is being fed to the image forming unit and the image forming operation by the image forming unit is being executed, the image forming operation is aborted. Therefore, for example, it is possible to suppress the occurrence of trouble that one image is formed over two recording mediums or a jam occurs due to recording mediums being transported in a stacked state.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

An exemplary embodiment of the invention will now be described with reference to FIGS. 1 to 14.

1. Overall Configuration of Printer

Figure 1:
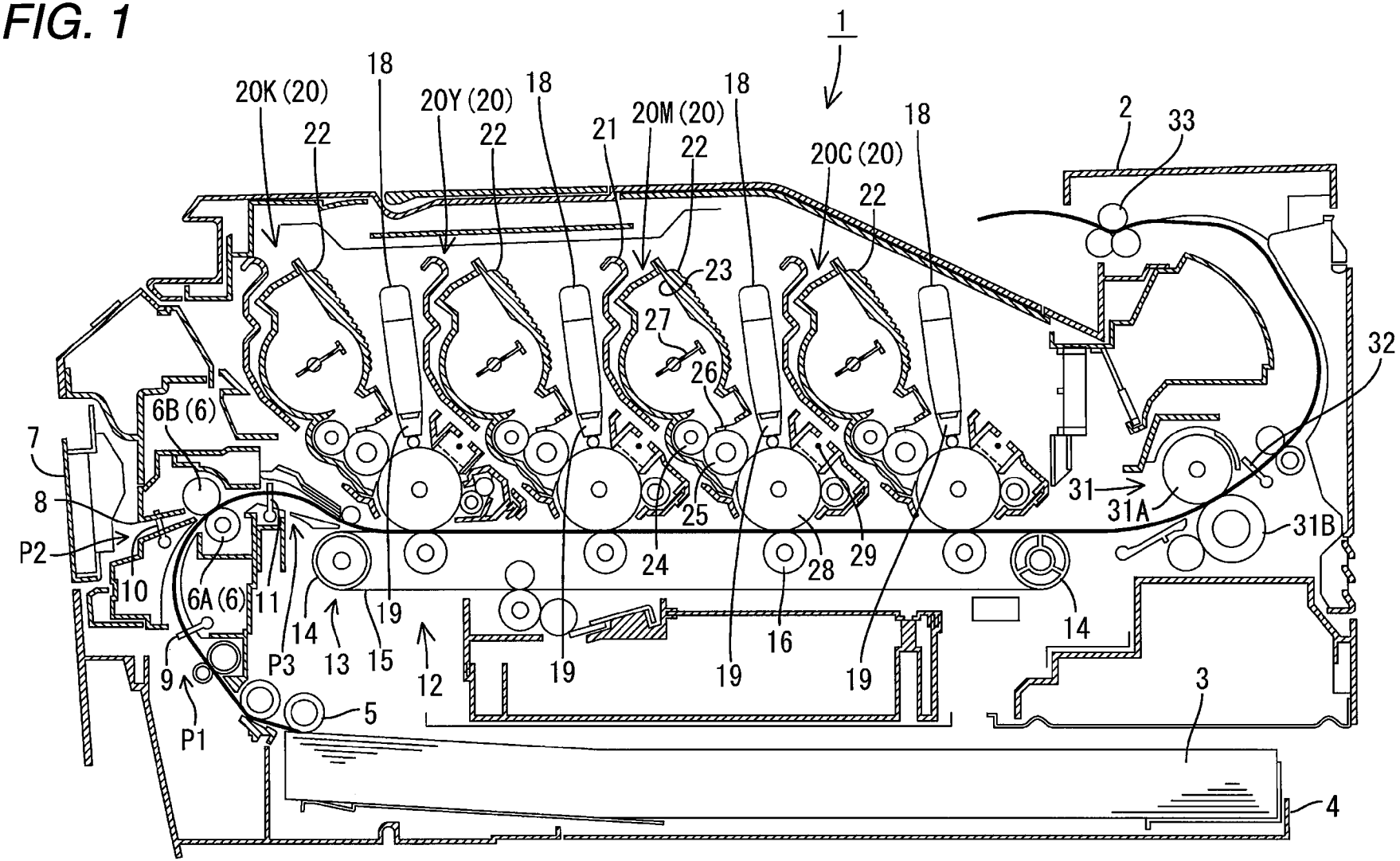
FIG. 1 is a side sectional view showing the schematic configuration of a printer according to an exemplary embodiment of the invention.

FIG. 1 is a side sectional view showing the schematic configuration of a printer 1 that is an example of an image forming apparatus of the invention. The printer 1 is a direct tandem type color printer that forms a color image by using toner of four colors (black K, yellow Y, magenta M, and cyan C). In the following description, the left side of FIG. 1 is referred to as a front side. In FIG. 1, with respect to the same parts for the respective colors, reference numerals will be appropriately omitted.

The printer 1 includes a main body casing 2, and a sheet feed tray 4 (an example of a stacking unit), disposed at a bottom portion inside the main body casing 2, in which a plurality of sheets 3 (an example of a recording medium) are stacked is provided. A sheet feed roller 5 (an example of a feed unit) is provided above a front end of the sheet feed tray 4, and an uppermost sheet 3 in the sheet feed tray 4 is fed to a feed path P1 provided at a front portion inside the main body casing 2 by rotation of the sheet feed roller 5. The feed path PI extends upward from a position corresponding to the sheet feed roller 5 and is curved in an arc shape.

A registration roller 6 (an example of a transport roller) is provided at an upper end of the feed path P1. The registration roller 6 has a driving roller 6A and a driven roller 6B. The driving roller 6A of the registration roller 6 is connected to a main motor 47 through a gear mechanism having a solenoid switch 6C (see FIG. 2). When the solenoid switch 6C is turned off, a driving force of the main motor 47 is transmitted to the driving roller 6A, and when the solenoid switch 6C is turned on, the driving force of the main motor 47 is cut off.

A manual feed guide 7 is provided at a front surface inside the main body casing 2 so as to be tilted forward, and a manual feed slot 8 into which the user can insert a recording medium, such as the sheet 3 or the like, is formed inside the manual feed guide 7. A part of the sheet 3 is placed on the manual feed guide 7 being tilted forward, and side wall portions of the manual feed guide 7 are fitted to the width of the sheet 3, such that the posture of the sheet 3 when being inserted from the manual feed slot 8 is adjusted. The manual feed slot 8 communicates with the registration roller 6 through a manual feed path P2, and a transport path P3 is provided at the back of the registration roller 6 so as to communicate with a belt unit 13 of an image forming unit 12 that will be described below.

The registration roller 6 can transport the sheet 3 fed from the feed path PI and the sheet 3 fed from the manual feed path P2 onto the belt unit 13 of the image forming unit 12 described below through the transport path P3. A registration roller front sensor 9, a manual feed sensor 10, and a registration roller end sensor 11 are provided on the feed path PI, the manual feed path P2, and the transport path P3, respectively. Each of the sensors 9, 10, and 11 detects presence/absence of the sheet 3 at a corresponding position.

The image forming unit 12 includes the belt unit 13, exposure sections 18, a process section 20, a fixer 31, and the like.

The belt unit 13 is configured such that a ring-shaped belt 15 made of polycarbonate or the like is stretched between a pair of front and rear belt support rollers 14. If the rear belt support roller 14 is driven to rotate, the belt 15 is revolved in a clockwise direction of the drawing, and the sheet 3 carried on the upper surface of the belt 15 is transported backward. Four transfer rollers 16 are provided inside the belt 15.

The exposure sections 18 and the process section 20 are provided above the belt unit 13. The exposure sections 18 include four LED units corresponding to the respective colors of black, yellow, magenta, and cyan, respectively. Each exposure section 18 has an LED head 19 at its lower end. Each exposure section 18 is configured such that light emission is controlled on the basis of image data to be formed, and irradiates light from the LED head 19 onto the surface of a photosensitive drum 28.

The process section 20 includes four process cartridges 20K, 20Y, 20M, and 20C corresponding to the four colors. Each of the process cartridges 20K to 20C includes a cartridge frame 21 and a developing cartridge 22 which is detachably mounted with respect to the cartridge frame 21. Each developing cartridge 22 includes a toner accommodating chamber 23 accommodating toner of each color as a developer. A supply roller 24, a developing roller 25, a layer thickness regulating blade 26, an agitator 27, and the like are provided below the toner accommodating chamber 23.

Toner emitted from the toner accommodating chamber 23 is supplied to the developing roller 25 by the rotation of the supply roller 24, and is positively frictionally charged between the supply roller 24 and the developing roller 25. Toner supplied onto the developing roller 25 enters between the layer thickness regulating blade 26 and the developing roller 25 by rotation of the developing roller 25, is frictionally charged sufficiently, and is carried on the developing roller 25 as a thin layer of a predetermined thickness.

Below the cartridge frame 21, a photosensitive drum 28, the surface of which is covered with a positively chargeable photosensitive layer, and a scorotron type charger 29 are provided. The photosensitive drum 28 forms a nip portion with the corresponding transfer roller 16 with the belt 15 interposed therebetween. At the time of image formation, the surface of the photosensitive drum 28 is uniformly positively charged by the charger 29. The positively charged portion is exposed by the exposure section 18, and an electrostatic latent image is formed on the surface of the photosensitive drum 28.

Next, toner that is carried on the developing roller 25 and positively charged is supplied to the electrostatic latent image on the surface of the photosensitive drum 28. As a result, the electrostatic latent image on the photosensitive drum 28 is visualized. Thereafter, the toner images carried on the surfaces of the respective photosensitive drums 28 are sequentially transferred to the sheet 3 by a negative transfer voltage to be applied to the transfer rollers 16 while the sheet 3 is passing through the nip positions between the photosensitive drums 28 and the transfer rollers 16.

The sheet 3 to which the toner images are transferred is transported to the fixer 31 by the belt unit 13. The fixer 31 includes a heating roller 31 A having a heat source, and a pressing roller 31B pressing the sheet 3 toward the heating roller 31A. While the sheet 3 is passing through the fixer 31, an image forming surface of the sheet 3 is pressed into contact with the heating roller 31A, and thus the transferred toner images are thermally fixed onto the surface of the sheet. A sheet discharge sensor 32 is provided on the downstream side of the fixer 31 so as to detect presence/absence of the sheet 3. The sheet 3 onto which the toner images are thermally fixed by the fixer 31 is transported upward, and is discharged onto an upper surface of the main body casing 2 by a discharge roller 33.

2. Electrical Configuration

Figure 2:
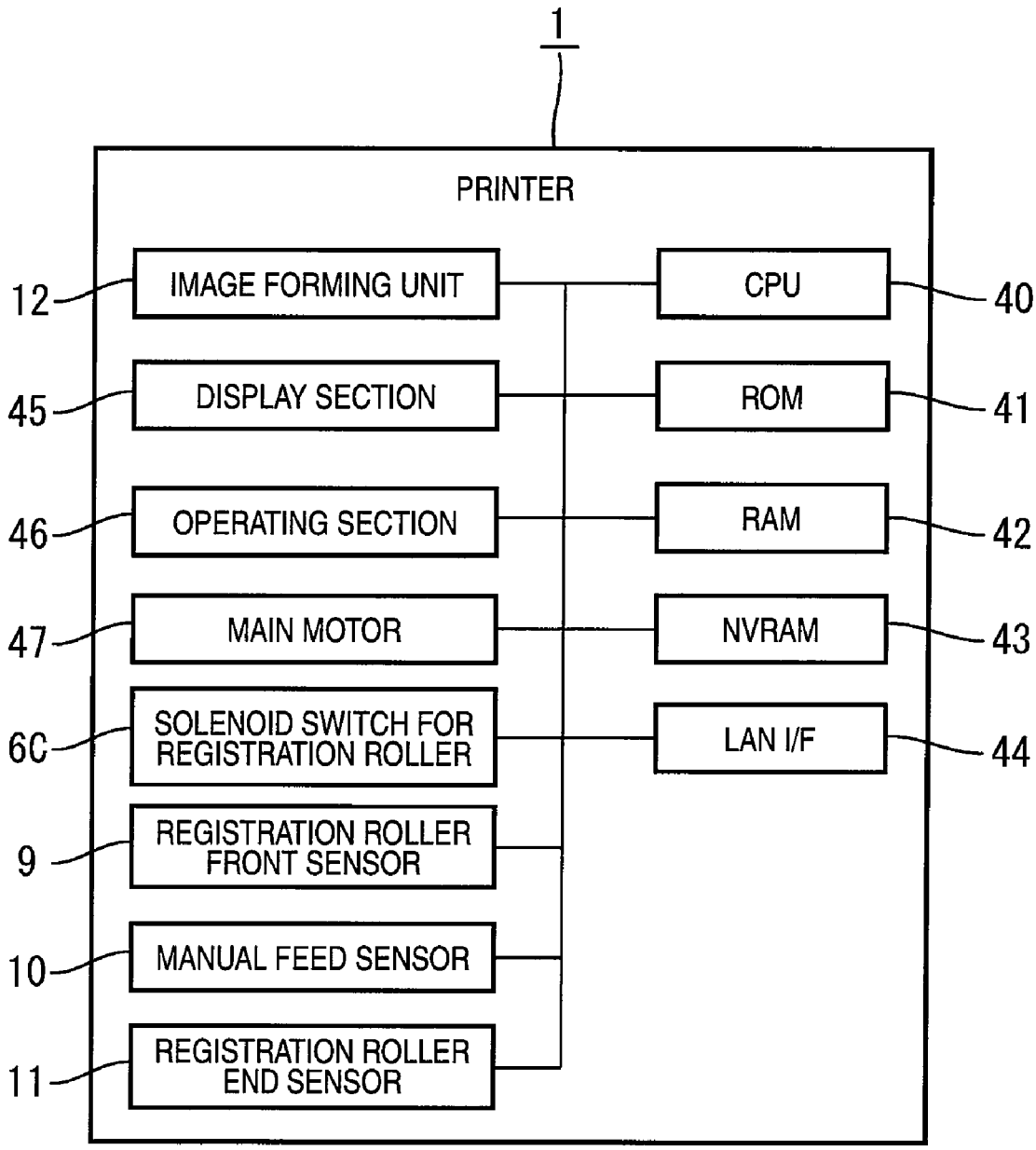
FIG. 2 is a block diagram schematically showing the electrical configuration of a printer.

FIG. 2 is a block diagram schematically showing the electrical configuration of the printer 1.

As shown in FIG. 2, the printer 1 includes a CPU 40 (an example of a control unit), a ROM 41, a RAM 42, a NVRAM (nonvolatile memory) 43, and a network interface 44. The image forming unit 12, the solenoid switch 6C of the registration roller 6, the registration roller front sensor 9, the manual feed sensor 10, and the registration roller end sensor 11, or a display section 45, an operating section 46, the main motor 47, and the like are connected to the CPU 40, the ROM 41, the RAM 42, the NVRAM 43, and the network interface 44.

The ROM 41 stores various programs for executing the operation of the printer 1, such as a tray sheet feed processing or a manual sheet feed processing described below. The CPU 40 controls the respective sections in accordance with the programs read out from the ROM 41 while storing the processing result in the RAM 42 or the NVRAM 43. The network interface 44 is connected to an external computer or the like through a communication line, such that mutual data communication is possible.

The display section 45 includes a liquid crystal display or a lamp, and can display various setup screens, the operation state of the apparatus, or the like. The operating section 46 includes a plurality of buttons, and allows the user to carry out various input operations. The main motor 47 synchronically rotates the sheet feed roller 5, the registration roller 6, the belt support rollers 14, the developing rollers 25, the photosensitive drums 28, the heating roller 31A, and the like through a gear mechanism.

3. Sheet Feed Mechanism

Figure 3:
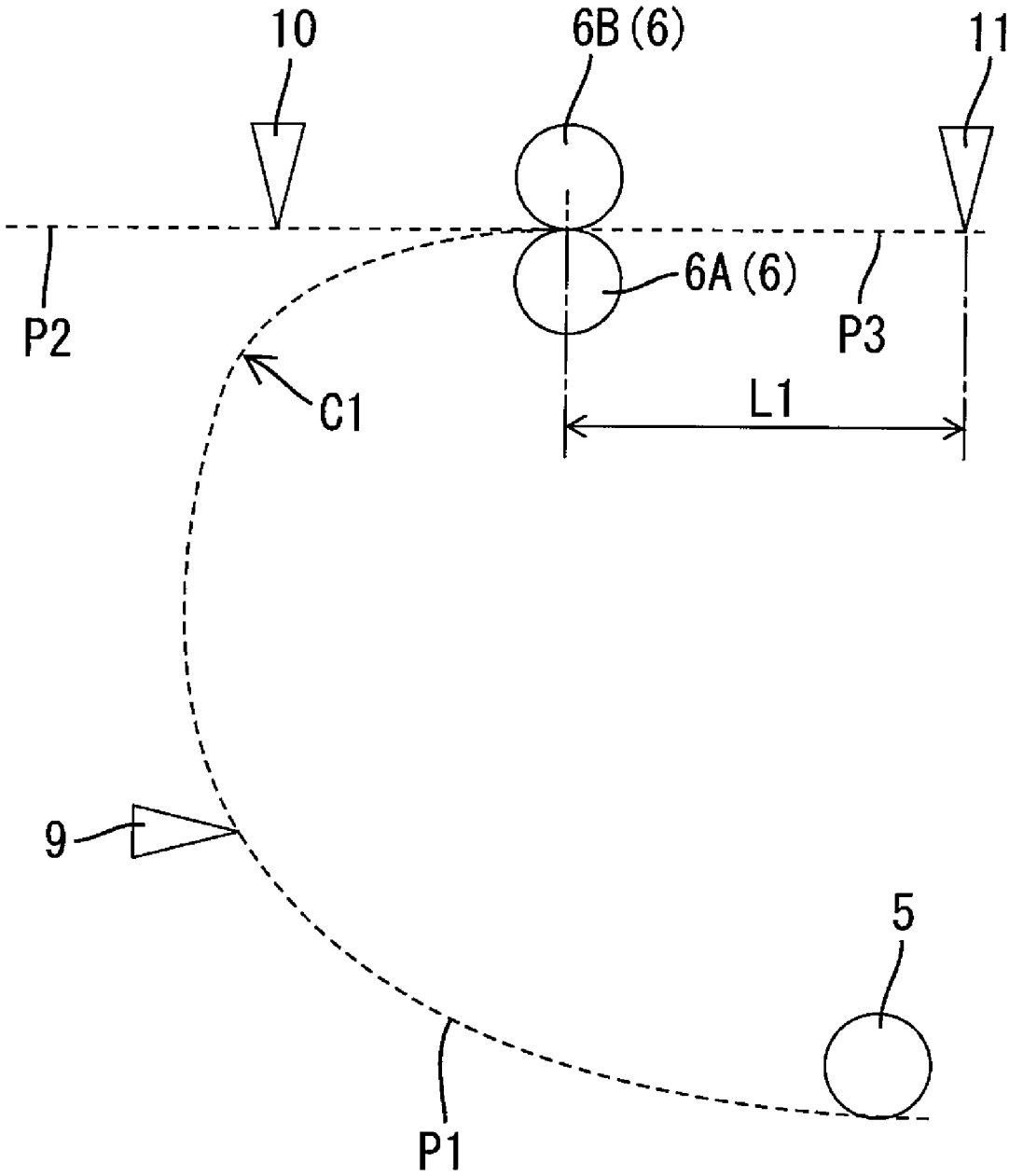
FIG. 3 is a diagram schematically showing a sheet feed mechanism of a printer.

FIG. 3 is a diagram schematically showing a sheet feed mechanism of the printer 1. In the printer 1, a sheet 3 stacked in the sheet feed tray 4 or a sheet 3 inserted from the manual feed slot 8 is fed to the image forming unit 12 through a tray sheet feed processing or manual sheet feed processing, which will be described below, and then printing is performed.

(Tray Sheet Feed Processing)

Figure 4:
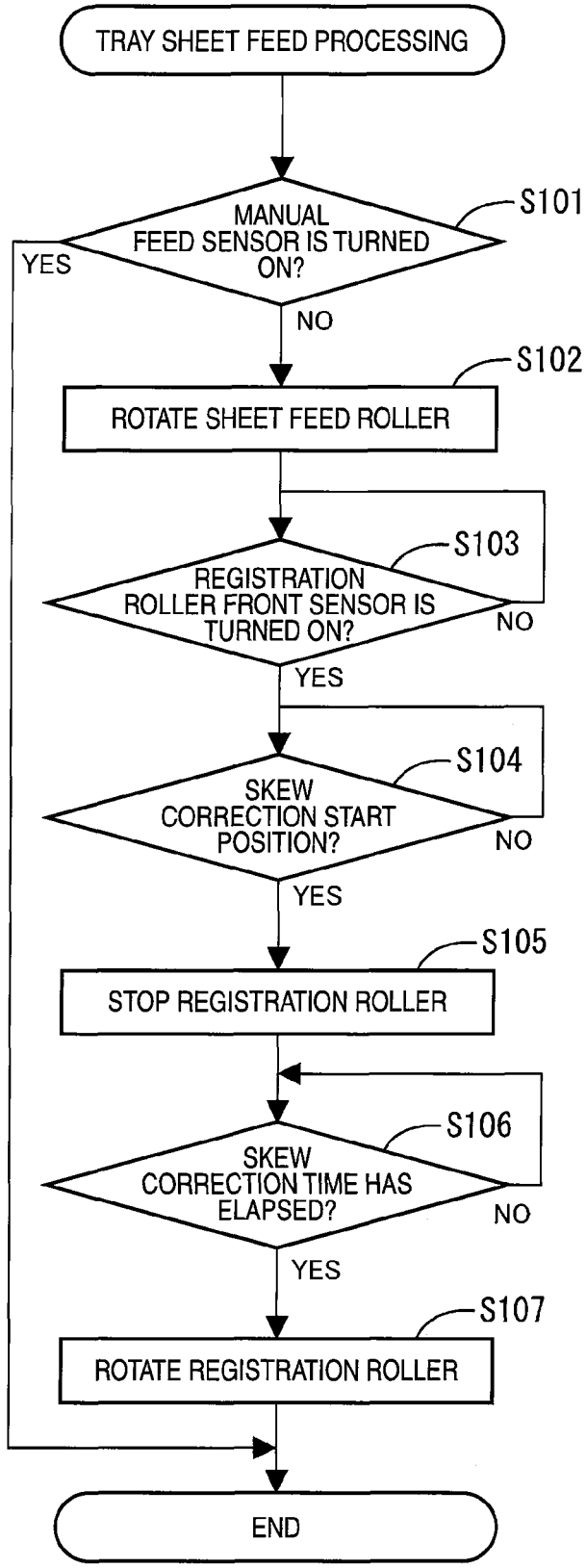
FIG. 4 is a flowchart showing the flow of a tray sheet feed processing.

FIG. 4 is a flowchart showing the flow of a tray sheet feed processing.

If a print command and print data are received from an external computer or the like through the network interface 44, the CPU 40 starts execution of a print processing (print data expansion processing and the like). During the printing processing, if there is a transport start request to start the transport of the sheet 3, the CPU 40 starts a tray sheet feed processing in parallel with the print processing.

As shown in FIG. 4, the CPU 40 first examines whether or not the manual feed sensor 10 is turned on (S101), and when the manual feed sensor 10 is turned on (S101: Yes), that is, when a sheet 3 is inserted into the manual feed path P2, ends the tray sheet feed processing. In this case, the sheet 3 inserted from the manual feed slot 8 from a manual sheet feed processing described below is fed to the image forming unit 12, and printing is performed.

When the manual feed sensor 10 is turned off (S101: No), the main motor 47 is driven and the sheet feed roller 5 starts to rotate by the driving force of the main motor 47 (S102). When this happens, the sheet 3 stacked in the sheet feed tray 4 is fed to the feed path P1. Then, the CPU 40 waits until the leading end of the fed sheet 3 turns on the registration roller front sensor 9 (S103), and if the registration roller front sensor 9 is turned on (S103: Yes), waits until the leading end of the sheet 3 reaches to a skew correction start position C1 (see FIG. 3) (S104).

The skew correction start position C1 is present on the upstream side of the registration roller 6. As described below, the skew correction start position C1 is set such that, if the solenoid switch 6C is turned on when the leading end of the sheet 3 has passed through the position C1, the registration roller 6 is reliably stopped until the leading end of the sheet 3 reaches the registration roller 6. If a predetermined period has elapsed after the registration roller front sensor 9 is turned on, the CPU 40 determines that the leading end of the sheet 3 reaches the skew correction start position C1.

If the leading end of the sheet 3 reaches the skew correction start position C1 (S104: Yes), the CPU 40 turns on the solenoid switch 6C of the registration roller 6, and stops the rotation of the registration roller 6 (S105). Next, the CPU 40 waits until a predetermined skew correction time has elapsed (S106). Before the skew correction time has elapsed, the leading end of the sheet 3 fed by the sheet feed roller 5 encounters the registration roller 6 that is in a stopped state.

Then, the CPU 40 turns off the solenoid switch 6C after the skew correction time has elapsed (S106: Yes) and rotates the registration roller 6 again (S107). When this happens, the sheet 3 is nipped by the registration roller 6 with the skew movement having been corrected and is then transported toward the belt unit 13. Thereafter, during the print processing, if it is detected that the leading end of the sheet 3 turns on the registration roller end sensor 11, the CPU 40 writes (exposes) an image onto the photosensitive drum 28 on the basis of the detection timing, and aligns the sheet 3 and the image to be transferred to the sheet 3.

(Manual Sheet Feed Processing)

FIGS. 5 to 8 are flowcharts showing the flow of a manual sheet feed processing. FIGS. 9 to 13 are diagrams illustrating the positional relationship between two sheets 3A and 3B in the sheet feed mechanism. Hereinafter, when it is necessary to distinguish the sheet 3 inserted from the manual feed slot 8 and the sheet 3 from the sheet feed tray 4, the former is represented by reference numeral 3A, and the latter is represented by reference numeral 3B.

Figure 5:
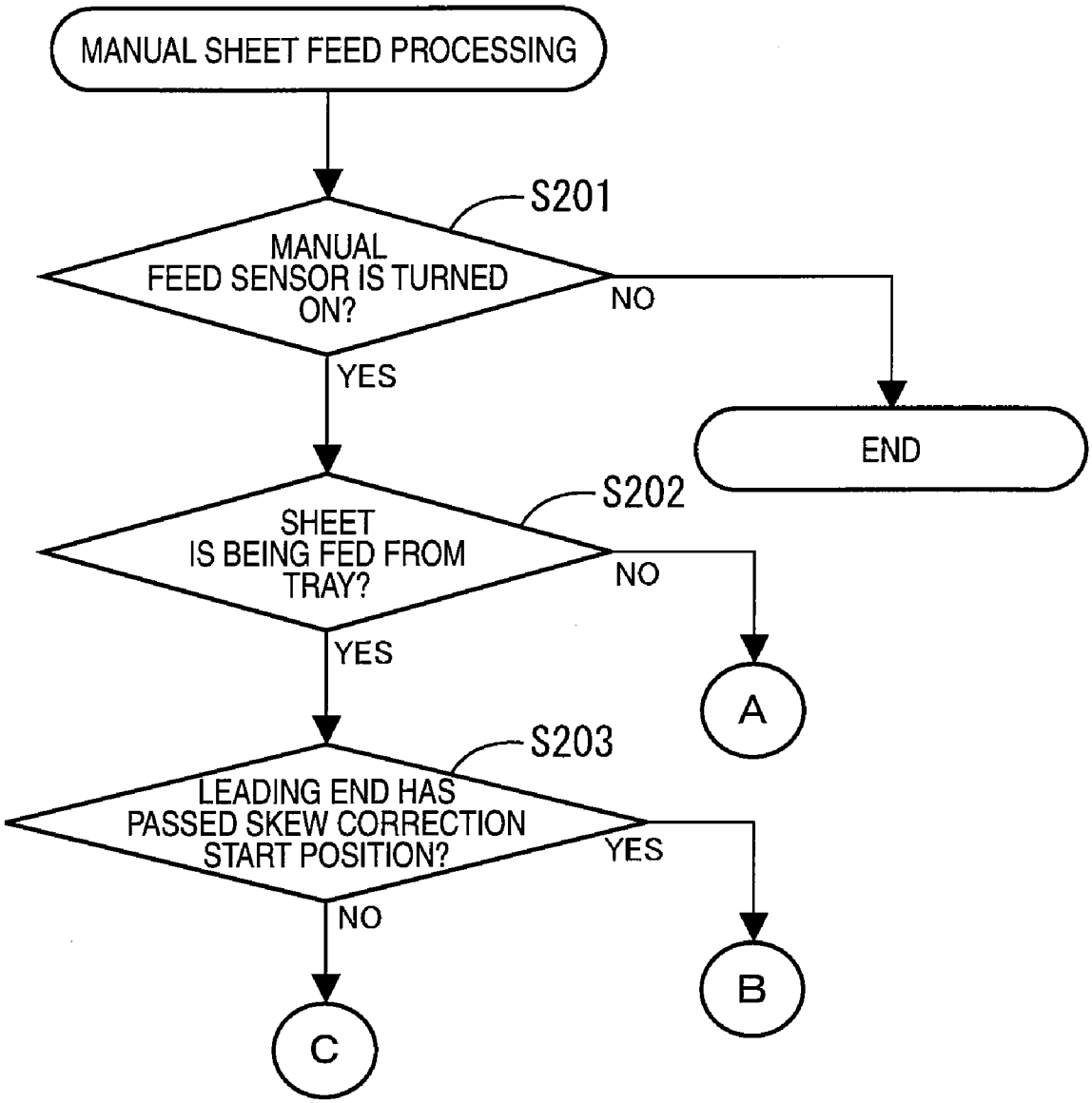
FIG. 5 is a flowchart showing the flow of a manual sheet feed processing.

The manual sheet feed processing is executed regularly under the control of the CPU 40 when the printer 1 can perform printing. As shown in FIG. 5, the CPU 40 first determines whether or not the manual feed sensor 10 is turned on (S201), and when the manual feed sensor 10 is not turned on (S201: No), ends the manual sheet feed processing. When the sheet 3A is inserted from the manual feed slot 8, and the manual feed sensor 10 is turned on (S201: Yes), it is determined whether or not the sheet 3B from the sheet feed tray 4 is being transported to the sheet feed roller 5 or the registration roller 6 by the above-described tray sheet feed processing (S202).

Figure 6:
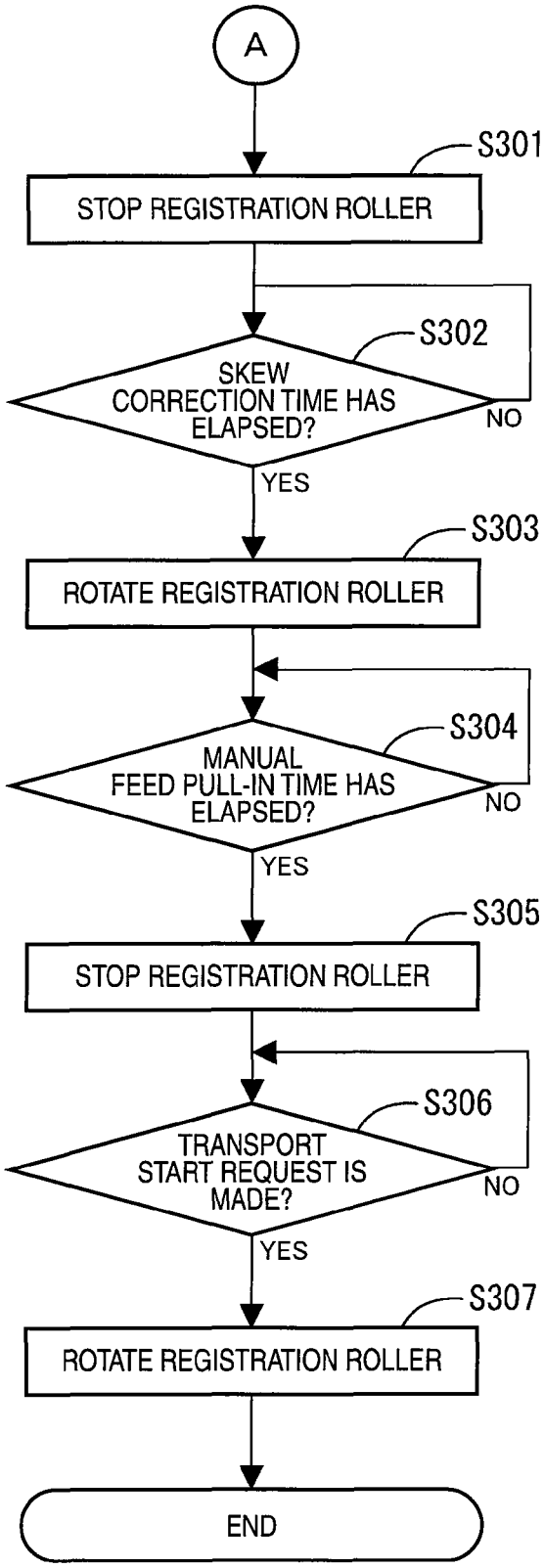
FIG. 6 is a flowchart showing the flow of a manual sheet feed processing.

When the sheet 3B from the sheet feed tray 4 is not being transported (S202: No), as shown in FIG. 6, rotation of the registration roller 6 is stopped (S301), and it waits until the skew correction time has elapsed (S302). During this period, the leading end of the sheet 3A inserted by the user encounters the registration roller 6 that is in a stopped state. Then, the CPU 40 rotates the registration roller 6 again (S303) after the skew correction time has elapsed (S302: Yes), and stops the registration roller 6 again (S305) after a predetermined manual feed pull-in time has elapsed (S304: Yes). When this happens, the leading end portion of the sheet 3A inserted by the user is pulled in and held by the registration roller 6 for a predetermined length with the skew movement having been corrected. Therefore, the user can release his/her hand from the held sheet 3A.

Next, the CPU 40 waits until a transport start request is made during the print processing in a state where the registration roller 6 is stopped (S306). Then, if the transport start request is made (S306: Yes), the CPU 40 rotates the registration roller 6 (S307), and ends the manual sheet feed processing. When this happens, the sheet 3A inserted from the manual feed slot 8 is transported onto the belt 15, and printing is performed on the sheet 3A.

In S202 of FIG. 5, when the manual feed sensor 10 is turned on, if the sheet 3B from the sheet feed tray 4 is being transported by the sheet feed roller 5 or the registration roller 6 during the tray sheet feed processing (S202: Yes), the CPU 40 determines whether or not the leading end of the sheet 3B has passed through the skew correction start position C1 (S203). When it is determined that the leading end of the sheet 3B from the sheet feed tray 4 has not passed through the skew correction start position C1, this means that the sheet 3A from the manual feed slot 8 has been fed first, and it has been determined that the skew correction operation by the registration roller 6 is executable for the sheet 3A from the manual feed slot 8 until the leading end of the sheet 3B from the sheet feed tray 4 reaches the registration roller 6, as described below.

Figure 7:
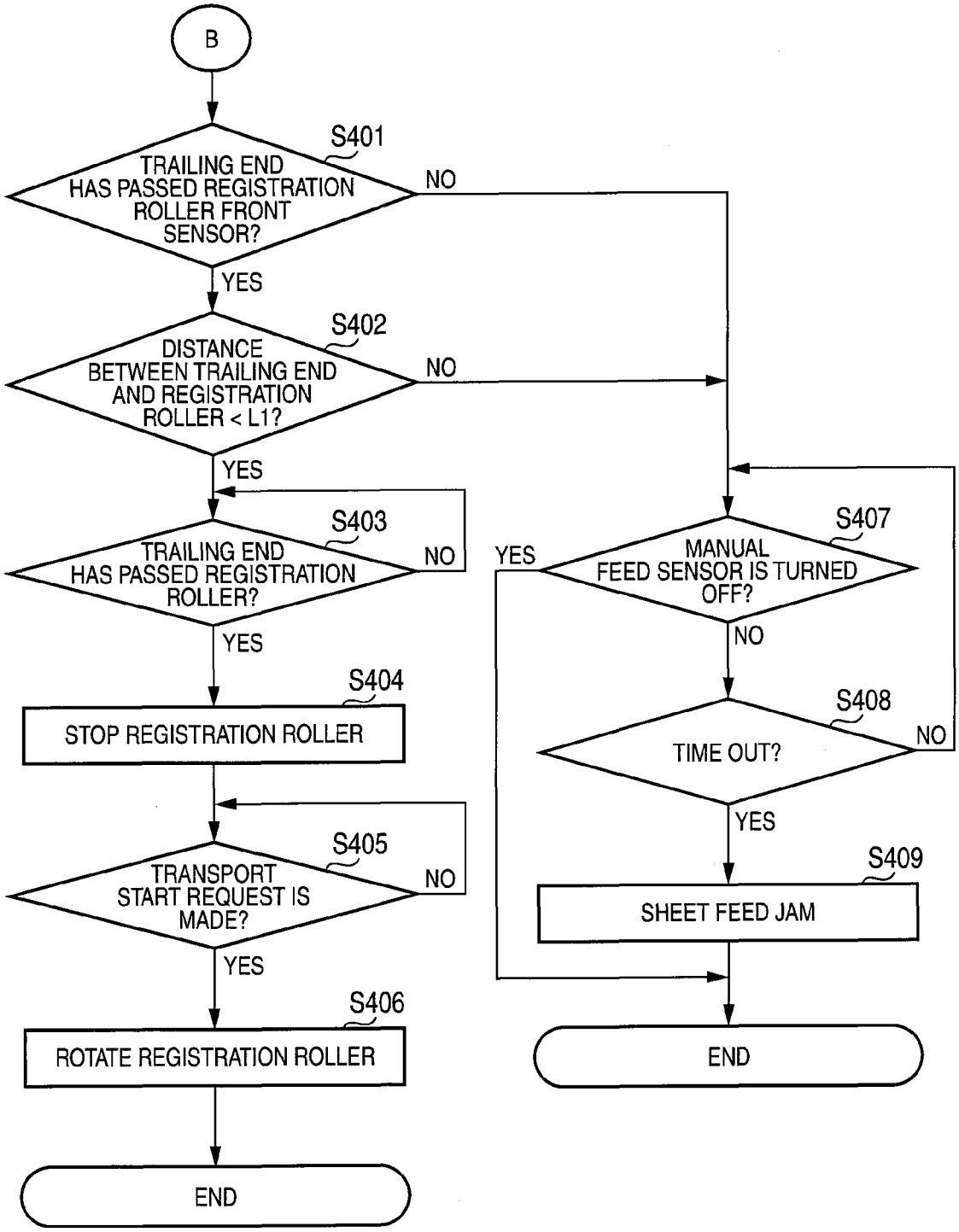
FIG. 7 is a flowchart showing the flow of a manual sheet feed processing.

Meanwhile, when it is determined that the leading end of the sheet 3B from the sheet feed tray 4 passes through the skew correction start position C1, this means that it has been determined that the skew correction operation by the registration roller 6 is not executable for the sheet 3A from the manual feed slot 8 until the leading end of the sheet 3B from the sheet feed tray 4 reaches the registration roller 6, and the sheet 3B from the sheet feed tray 4 precedes the sheet 3A from the manual feed slot 8. When it is determined that the leading end of the sheet 3B from the sheet feed tray 4 has passed through the skew correction start position C1 (S203: Yes), as shown in FIG. 7, the CPU 40 further determines whether or not the trailing end of the sheet 3B has passed through the position of the registration roller front sensor 9 (S401).

When the trailing end of the sheet 3B from the sheet feed tray 4 has passed through the position of the registration roller front sensor 9 (S401: Yes), the CPU 40 subsequently determines whether or not the trailing end of the sheet 3B is within range of an upstream side length L1 of the registration roller 6 (S402). As shown in FIG. 3, the length L1 is set so as to be substantially equal to the distance between the registration roller 6 and the registration roller end sensor 11. Then, when the trailing end of the sheet 3B from the sheet feed tray 4 is within the range of the upstream side length L1 of the registration roller 6 (S402: Yes), the CPU 40 waits until the trailing end of the sheet 3B has passed through the registration roller 6 (S403).

Figure 9:
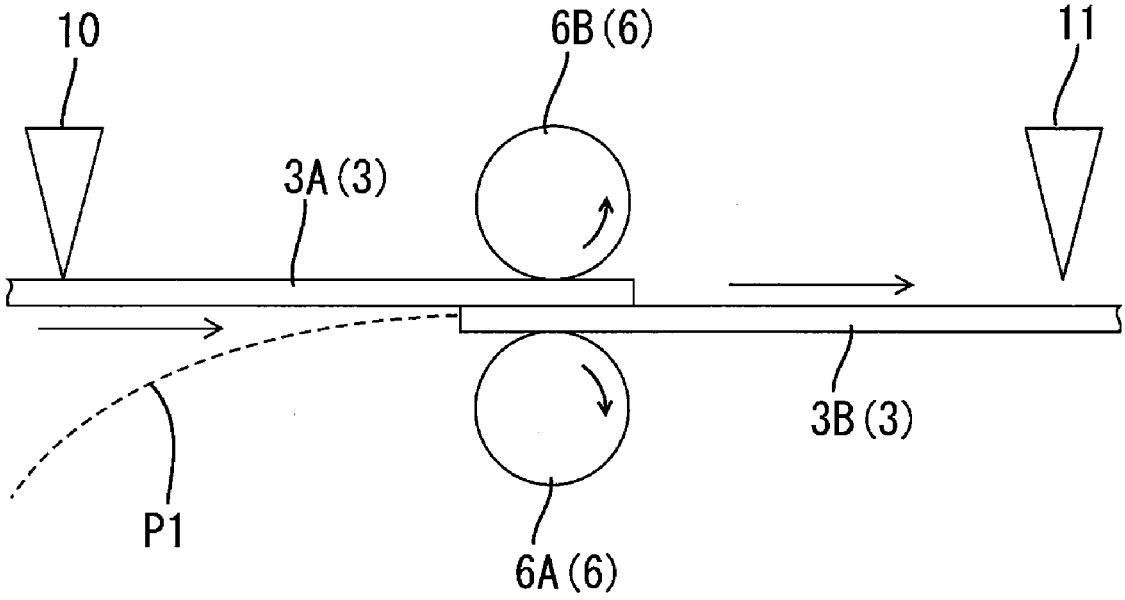
FIG. 9 is a diagram illustrating the positional relationship between two sheets in a sheet feed mechanism.
Figure 10:
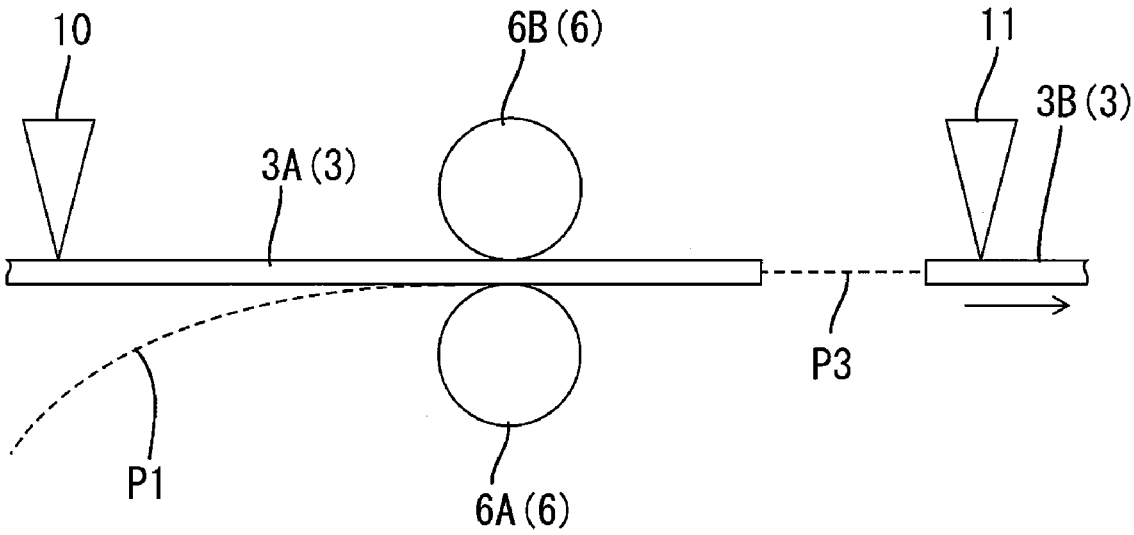
FIG. 10 is a diagram illustrating the positional relationship (a state subsequent to FIG. 9) between two sheets in a sheet feed mechanism.

During this period, when the leading end of the sheet 3A inserted from the manual feed slot 8 reaches the registration roller 6, for example, as shown in FIG. 9, the leading end of the sheet 3A is pulled in the registration roller 6 while being stacked on the upper surface (image forming surface) of the sheet 3B from the sheet feed tray 4. If the trailing end of the sheet 3B from the sheet feed tray 4 has passed through the registration roller 6 (S403: Yes), the CPU 40 stops the registration roller 6 (S404). When this happens, as shown in FIG. 10, the preceding sheet 3B from the sheet feed tray 4 is transported backward by the belt 15, and the succeeding sheet 3A from the manual feed slot 8 stops before the leading end thereof has reached the registration roller end sensor 1.

Next, the CPU 40 waits until the next transport start request is made (S405), if the transport start request is made, rotates the registration roller 6 (S406), and transports the sheet 3A from the manual feed slot 8 backward. Thereafter, as described above, the CPU 40 adjusts the write position of an image onto the photosensitive drum 28 on the basis of the timing at which the leading end of the sheet 3A turns on the registration roller end sensor 11, and performs printing on the sheet 3A.

In S401, when the trailing end of the sheet 3B from the sheet feed tray 4 has not passed through the position of the registration roller front sensor 9 (S401: No), or in S402, when the trailing end of the sheet 3B is present on the upstream side from the range of the upstream side length L1 of the registration roller 6 (S402: No), it is determined whether or not manual feed sensor 10 is turned off (S407). When the manual feed sensor 10 is turned off, this means that, for example, the sheet 3A that had once been inserted into the manual feed slot 8 by the user has been pulled out. In such a case (S407: Yes), the manual sheet feed processing ends.

When the manual feed sensor 10 is turned on (S407: No), if a predetermined timeout time has not elapsed (S408: No), the processing returns to S407, and it is determined whether or not the manual feed sensor 10 is turned off. Then, when the timeout time has elapsed while the manual feed sensor 10 is turned on (S408: Yes), a jam processing is carried out (S409). During this jam processing, the driving of the main motor 47 stops to stop transport of the sheet 3 in the entire printer 1 and to stop the image forming operation, and an indication that a jam error has occurred is displayed on the display section 45.

As described above, at the time of determination on presence/absence of the jam error, it is determined whether or not the manual feed sensor 10 that had once been turned on is turned off within a predetermined period (S407 and S408), and when the manual feed sensor 10 is turned off, it is determined that no error has occurred. In this way, the determination accuracy can be increased. When it is determined to be No in S401 or when it is determined to be No in S402, the jam processing may be immediately carried out without carrying out the determination (S407 and S408) on whether or not the manual feed sensor 10 is turned off.

Figure 11:
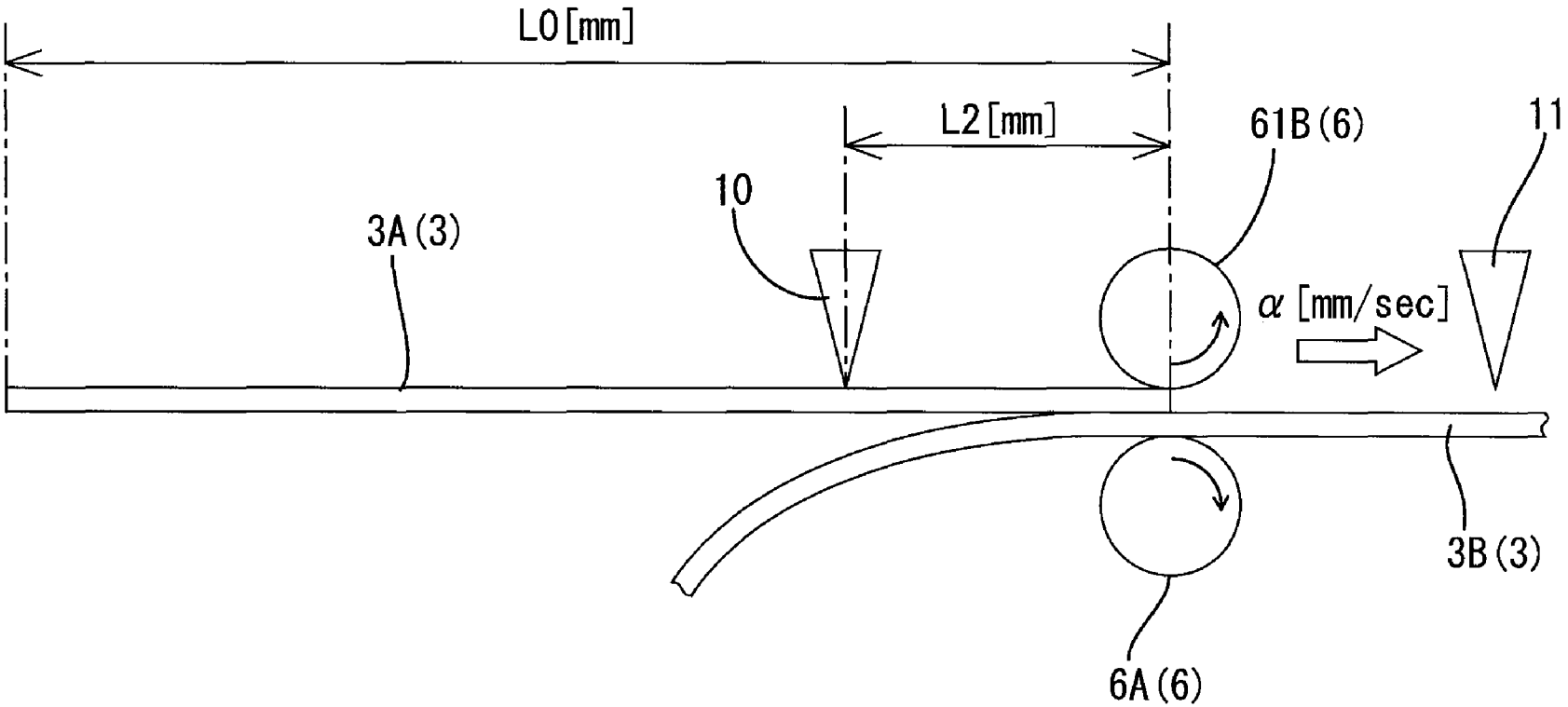
FIG. 11 is a diagram illustrating the positional relationship between two sheets in a sheet feed mechanism.

As shown in FIG. 11, let the minimum length of the sheet 3 to be used (transported) in the printer 1 be L0 [mm], the length between the manual feed sensor 10 and the nip position of the registration roller 6 be L2 [mm], and the transport speed of the sheet 3 by the registration roller 6 be a [mm/sec], then, a time until the manual feed sensor 10 is turned off after having been turned on is taken into consideration.

A time until the leading end of the sheet 3 to be inserted by the user reaches the registration roller 6 from the manual feed sensor 10 is indeterminate, and thus it is neglected. Then, if the leading end of the sheet 3 is transported from the nip position of the registration roller 6 at the transport speed a, a time until the trailing end of the sheet 3B, which has the length LO, passes through the manual feed sensor 10 will be $(L0-L2)/\alpha$[sec]. That is, if the sheet 3 is normally transported, the manual feed sensor 10 is turned on for at least a time equal to $(L0-L2)/\alpha$[sec], and if the manual feed sensor 10 is turned off before the time $(L0-L2)/\alpha$[sec] elapses, it can be determined that the sheet 3A inserted into the manual feed slot 8 has been pulled out in the meantime. Therefore, during the above-described processing, if the timeout time is set to $(L0-L2)/\alpha$ [sec], when the sheet 3A inserted into the manual feed slot 8 is pulled out while the sheet 3B from the sheet feed tray 4 is being transported, it is possible to suppress the determination that an error occurred and to suppress the stopping of the image forming operation.

Figure 12:
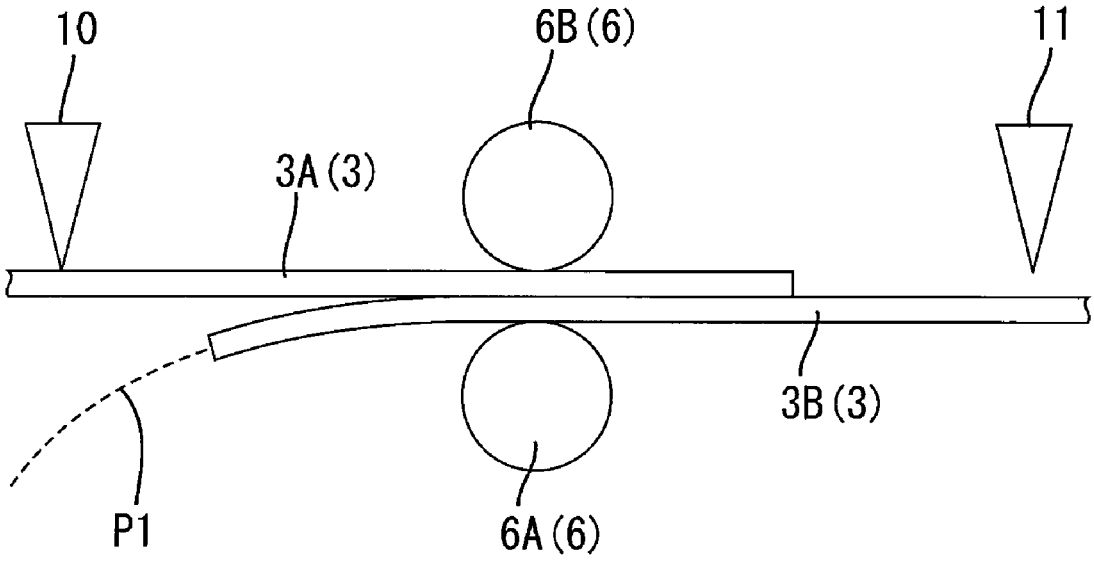
FIG. 12 is a diagram illustrating the positional relationship between two sheets in a sheet feed mechanism.

As described above, when the timeout time has elapsed while the manual feed sensor 10 is turned on (S408: Yes), for example, as shown in FIG. 12, it is determined that the sheets 3A and 3B are transported with the succeeding sheet 3A from the manual feed slot 8 being stacked on the upper surface (image forming surface) of the preceding sheet 3B from the sheet feed tray 4. In this state, if image formation is continued, an image is highly likely to be printed over the two sheets 3A and 3B. In this state, if image formation is continued, a space may not be formed at the leading end portion of the upper surface of the succeeding sheet 3A. In this case, if the succeeding sheet 3A reaches the fixer 31 in such a state, unfixed toner may be stuck to the heating roller 31A, and the sheet 3A may be wound around the fixer 31. As a result, it is likely that the sheet 3A will not be easily removed. Therefore, when the two sheets 3A and 3B are transported in the state of FIG. 12, if the main motor 47 stops and the image forming operation is aborted, the above-described problem can be prevented.

Figure 8:
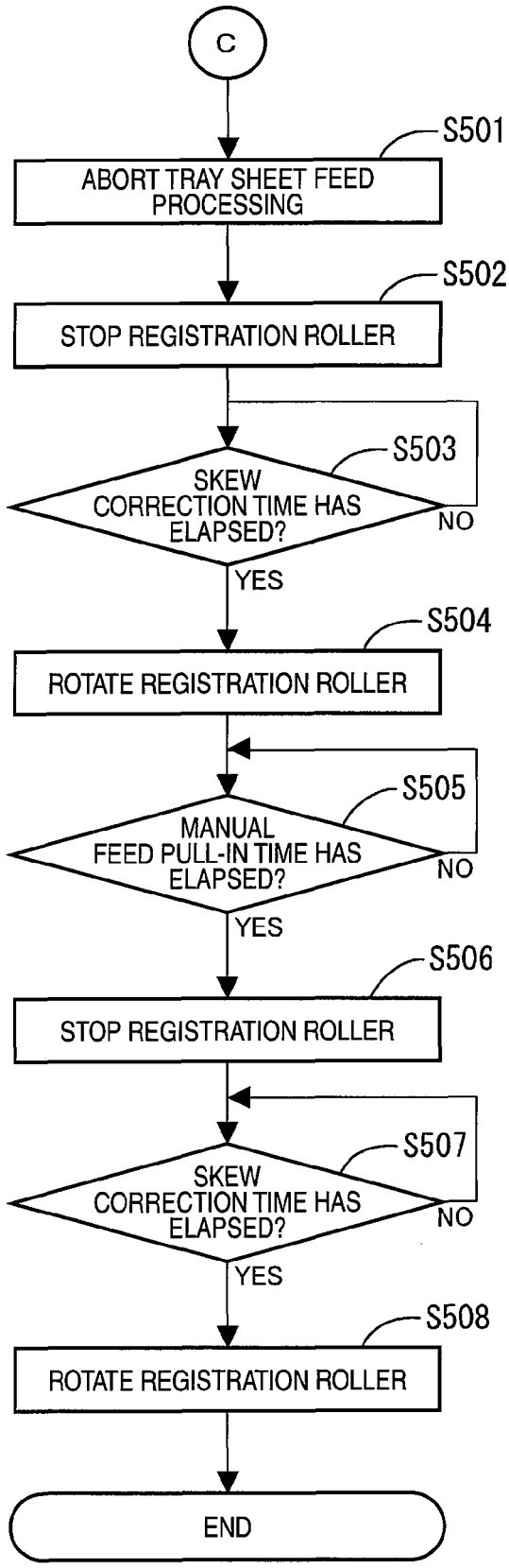
FIG. 8 is a flowchart showing the flow of a manual sheet feed processing.

In S201 of FIG. 5, when the manual feed sensor 10 is turned on, if the sheet 3B from the sheet feed tray 4 is being transported by the tray sheet feed processing (S202: Yes), and the leading end of the sheet 3B has not passed through the skew correction start position C1 (S203: No), as shown in FIG. 8, the CPU 40 aborts the tray sheet feed processing being executed in parallel with the print processing (S501). In this case, the feed operation of the sheet 3 of the sheet feed tray 4 being transported by the sheet feed roller 5 is continued. Then, the CPU 40 stops the registration roller 6 (S502), and waits in that state until the skew correction time has elapsed (S503). During this period, the leading end of the sheet 3A inserted from the manual feed slot 8 encounters the registration roller 6.

After the skew correction time has elapsed (S503: Yes), the CPU 40 rotates the registration roller 6 (S504), and waits in that state until the manual feed pull-in time has elapsed (S505). When this happens, the sheet 3A is pulled in the registration roller 6 with the skew movement having been corrected. If the manual feed pull-in time has elapsed (S505: Yes), the registration roller 6 stops (S506). When this happens, the sheet 3A inserted from the manual feed slot 8 is held while pulled in the registration roller 6, and thus the user can release his/her hand from the inserted sheet 3A.

Figure 13:
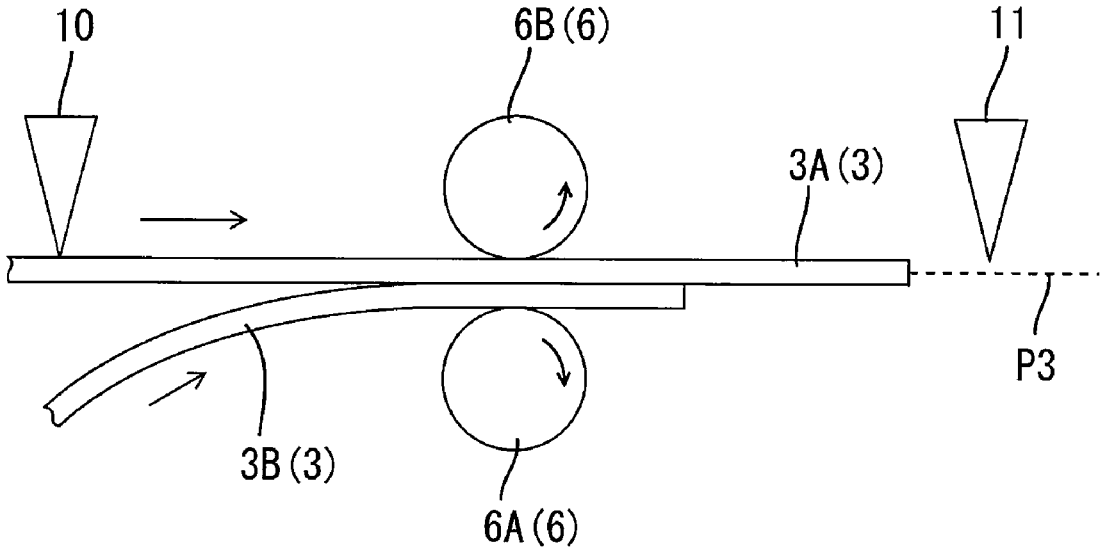
FIG. 13 is a diagram illustrating the positional relationship between two sheets in a sheet feed mechanism.

Next, in a state where the sheet 3A from the manual feed slot 8 is nipped by the registration roller 6, the CPU 40 waits until the leading end of the sheet 3B from the sheet feed tray 4 reaches the registration roller 6 and the skew correction time has elapsed (S507), and after the skew correction time has elapsed (S507: Yes), rotates the registration roller 6 (S508). When this happens, for example, as shown in FIG. 13, the sheet 3B from the sheet feed tray 4 is pulled in the registration roller 6 with the skew movement having been corrected and while being stacked on the lower side of the preceding sheet 3A from the manual feed slot 8, both sheets 3A and 3B are transported in a stacked state.

Thereafter, the CPU 40 adjusts the write position of the image on the basis of the timing at which the leading end of the sheet 3A from the preceding manual feed slot 8 is detected by the registration roller end sensor 11, and performs printing on the sheet 3A from the manual feed slot 8.

The transport error is checked on the basis of the detection timing of the sheet 3 by each of the sensors 9, 10, 11, and 32 while the sheet 3 is being transported. That is, when the registration roller end sensor 11 is not turned on within a predetermined period after the sheet 3B from the sheet feed tray 4 turns on the registration roller front sensor 9, or when the registration roller end sensor 11 is not turned on within a predetermined period after the manual feed sensor 10 is turned on, it is determined that a transport error has occurred, and the image forming operation stops. As described above, when the two sheets 3A and 3B are transported in a stacked state with the sheet 3A from the manual feed slot 8 having been fed first, the CPU 40 sets a regular time for the checking of the transport error so as to be shorter than the case where the sheet 3A from the manual feed slot 8 is transported alone.

This is because the sheet 3A inserted by the user is liable to become more unstable positionally than the sheet 3B from the sheet feed tray 4. In such a case, if the error determination conditions become more stricter than usual, it is possible to accurately determine whether or not the sheet 3A from the manual feed slot 8 normally precedes the sheet 3B from the sheet feed tray 4, and as a result, it is possible to suppress the occurrence of trouble due to the transport error. The regular time may be measured on the basis of a time from when the sheet 3A from the manual feed slot 8 is pulled in the registration roller 6 and the registration roller 6 restarts the rotation until the leading end of the sheet 3A reaches the registration roller end sensor 11.

(Manual Feed Indicator)

Figure 14:
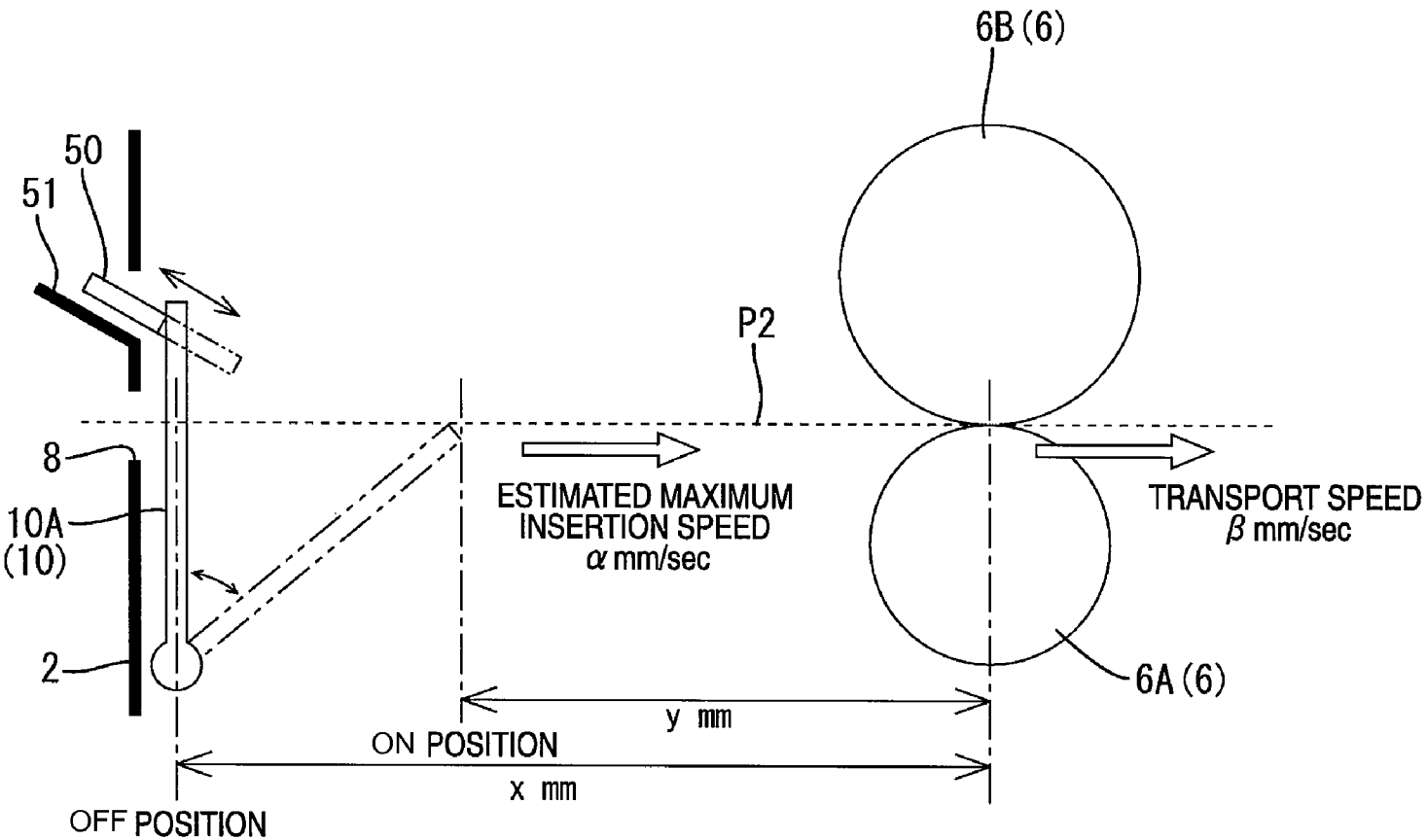
FIG. 14 is a diagram schematically showing the configuration around a manual feed indicator.

FIG. 14 is a diagram schematically showing the configuration around a manual feed indicator 50.

The manual feed indicator 50 informs the user of a timing at which, in the case that a plurality of sheets 3 are successively inserted from the manual feed slot 8 and printing is performed, a succeeding sheet 3 next to a preceding sheet 3 is inserted into the manual feed slot 8.

A window 51 is provided at the front surface of the main body casing 2 near the manual feed slot 8. The manual feed indicator 50 is provided so as to be displaced between a permission position (solid line) where the manual feed indicator 50 forges through the window 51 and becomes visible from the outside, and an inhibition position (two-dot-chain line) where the manual feed indicator 50 becomes invisible. The manual feed sensor 10 includes a pivot member 10A that is pivotable between an off position (solid line) across the manual feed path P2 and an on position (two-dot-chain line) where it is brought into contact with the sheet 3 in the manual feed path P2 and retracted from the manual feed path P2. The manual feed sensor 10 outputs a detection signal on the basis of the pivot member 10A. The pivot member 10A is pressed toward the off position by a spring member.

When the pivot member 10A is at the off position, the manual feed indicator 50 is pressed by the pivot member 10A and is located at the permission position. When the pivot member 10A is at the on position, the manual feed indicator 50 is not pressed by the pivot member 10A, and thus it is located at the inhibition position. The manual feed indicator and the pivot member may be mechanically connected to each other such that the manual feed indicator and the pivot member are in conjunction with each other, or an indicator may be provided in the pivot member itself so as to become visible from the outside.

A condition, which is suitable for the manual feed indicator 50 to indicate the manual feed timing, is obtained based on following assumptions (1) to (4).

(1) Distance between the off position of the pivot member 10A and the nip position of the registration roller 6: x [mm]

(2) Distance between the on position of the pivot member 10A and the nip position of the registration roller 6: y [mm]

(3) Estimated maximum insertion speed at the time of insertion of the sheet 3 by the user: $\alpha$ [mm/sec]

(4) Minimum sheet transport speed by the registration roller 6: $\beta$ [mm/sec]

For the appropriate operation of the manual feed indicator 50, it should suffice that the sheet 3 inserted at the timing at which the pivot member 10A is at the on position is separated from the previously inserted sheet 3 at the nip position of the registration roller 6. In order to separate the preceding sheet 3 and the succeeding sheet 3 from each other, it should suffice that the time until the trailing end of the preceding sheet 3 passes through the on position and reaches the nip position of the registration roller 6 is shorter than the time until the leading end of the succeeding sheet 3 passes through the off position and reaches the nip position of the registration roller 6. Therefore, the following equations need to be established as the conditions.

$$(y/\beta)<(x/\alpha) \quad \text{[Equation 1]}$$

When the manual feed sensor 10 is turned on while the registration roller 6 is rotating at the maximum speed, let a time until the CPU 40 turns on the solenoid switch 6C to completely stop rotation of the registration roller 6 be z [sec], then, the maximum insertion speed of the sheet 3 that allows the leading end of the sheet 3 inserted from the manual feed slot 8 to be stopped by the registration roller 6 will be x/z [mm/sec]. This value becomes the upper limit value of α.

A specific example is as follows.

Distance between the off position of the pivot member 10A and the nip position of the registration roller 6: x =50 [mm]

Distance between the on position of the pivot member 10A and the nip position of the registration roller 6: y [mm]

Minimum sheet transport speed by the registration roller 6: β=60 [mm/sec]

Stop time of the registration roller 6: z=0.2 [sec]In this case, if the estimated maximum insertion speed α is set as the upper limit value, Equation 2 is obtained.

$$\alpha = x/z = 50/0.2 = 250 \text{ [mm/sec]} \quad \text{[Equation 2]}$$

From Equation 1, Equation 3 is obtained, and as a result, Equation 4 is obtained.

$$(y/\beta) < (x/\alpha) = (y/60) < (50/250) \quad \text{[Equation 3]}$$

$$y < 12 \text{ [mm]} \quad \text{[Equation 4]}$$

In the above-described example, therefore, if the distance between the on position of the pivot member 10A and the nip position of the registration roller 6 is less than 12 mm, even though the sheet 3 is transported at the minimum sheet transport speed (in the case of printing of a thick sheet or the like), the previously inserted sheet 3 and the subsequently inserted sheet 3 can be separated from each other. As described above, the user views displacement of the manual feed indicator 50 from the inhibition position to the permission position, and then inserts the succeeding sheet 3. Therefore, the user can insert the sheet 3 at an appropriate timing such that the sheet 3 and the preceding sheet 3 are not transported in a stacked state. Therefore, in the case of successive manual sheet feed, printing can be smoothly performed.

4. Advantages of this Embodiment

As described above, according to the exemplary embodiment, when the sheet 3A is inserted from the manual feed slot 8 while the sheet 3B of the sheet feed tray 4 is being fed to the image forming unit 12 and the image forming operation is being executed, the image forming operation is aborted. Therefore, it is possible to suppress the occurrence of trouble that one image is formed over the two sheets 3A and 3B, or a jam occurs due to the sheets 3A and 3B being transported in the stacked state.

When it is determined that the succeeding sheet 3A is transported to the image forming unit 12 while being stacked on the image forming surface of the preceding sheet 3B, the image forming operation is aborted, and when it is determined that the sheets 3A and 3B are not transported to the image forming unit 12 in a stacked state, the image forming operation is continued. Therefore, when the succeeding sheet 3B is stacked on the surface opposite to the image forming surface of the preceding sheet 3A, an image is highly likely to be normally formed on the preceding sheet 3A. As a result, wasteful consumption of the sheet 3 can be suppressed, and time and effort required for the restart of the image forming operation can be saved.

When the sheet 3A that is stacked on the image forming surface of the sheet 3B is fed first, if it is determined that the skew correction of the preceding sheet 3A is executable before the succeeding sheet 3B reaches registration roller 6, the skew correction operation of the preceding sheet 3A is executed by the registration roller 6. Therefore, an image can be formed on the sheet 3A that is transported with the skew movement having been corrected.

When the sheets 3A and 3B are transported in a stacked state with the sheet 3A from the manual feed slot 8 having been fed first, it is considered that the transport state of the sheet 3A is highly likely to become more unstable than usual. For this reason, in such a case, the determination conditions become more stricter than usual, and thus it is accurately determined whether or not the sheet 3A from the manual feed slot 8 normally precedes the sheet 3B from the sheet feed tray 4. Therefore, the occurrence of trouble due to a transport error can be suppressed.

When the preceding sheet 3B and the succeeding sheet 3A are transported to the registration roller 6 in a stacked state, if it is determined that the leading end of the succeeding sheet 3A has not reached the registration roller end sensor 11 when the trailing end of the preceding sheet 3B has passed through the registration roller 6, the image forming operation is continued. Before the leading end of the succeeding sheet 3A reaches the registration roller end sensor 11 after the trailing end of the preceding sheet 3B has passed through the registration roller 6, the registration roller 6 is stopped. Therefore, even if the preceding sheet 3A and the succeeding sheet 3B are transported to the registration roller 6 in a stacked state, both sheets 3A and 3B are separated before the image forming unit 12, and thus the image forming operation is not stopped. The succeeding sheet 3A is separated from the preceding sheet 3B before the registration roller end sensor 11. As a result, detection of the sheets 3A and 3B by the registration roller end sensor 11 can be accurately carried out.

The succeeding sheet 3A that is separated from the preceding sheet 3B can be used for the next image forming operation. Therefore, the image forming operation is not stopped, and as a result, the convenience of use can be improved.

The insertion timing of the sheet 3 from the manual feed slot 8 is indicated by the manual feed indicator 50 that is in conjunction with the pivot member 10A provided in the manual feed sensor 10. Therefore, the sheets 3 can be successively inserted from the manual feed slot 8, and as a result, the image forming operation can be smoothly carried out.

<Other Exemplary Embodiments>

The invention is not limited to the exemplary embodiment described above and shown in the drawings, and the following embodiments also fall within the technical scope of the invention.

(1) While in the foregoing embodiment, the case where the sheet from the manual feed slot is stacked on the image forming surface of the sheet from the sheet feed tray has been described, the invention may be applied to the case where the sheet from the sheet feed tray is stacked on the image forming surface of the sheet from the manual feed slot.

(2) While in the foregoing embodiment, the example where the invention is applied to a direct transfer type color printer has been described, the invention may be applied to other types of image forming apparatuses, such as an intermediate transfer type printer, a monochrome printer, an ink jet type printer, and the like.

According to an illustrative first aspect of the present invention, there is provided an image forming apparatus comprising: an image forming unit that forms an image on a recording medium; a transport roller that transports a recording medium to the image forming unit; a stacking unit that stacks a recording medium; a manual feed path that extends from a manual feed slot to the transport roller; a feed path that extends from the stacking unit to the transport roller; a feed unit that transports the recording medium stacked in the stacking unit to the transport roller through the feed path; a first detection unit that detects a recording medium inserted into the manual feed path from the manual feed slot; and a control unit, when the first detection unit detects the recording medium inserted from the manual feed slot while an operation to feed the recording medium of the stacking unit to the image forming unit by the feed unit and the transport roller, and an image forming operation by the image forming unit are executed, that is configured to abort the image forming operation by the image forming unit.

According to the first aspect of the invention, when a recording medium is inserted from the manual feed slot while a recording medium of the stacking unit is being fed to the image forming unit and the image forming operation by the image forming unit is being executed, the image forming operation is aborted. Therefore, for example, it is possible to suppress the occurrence of trouble that one image is formed over two recording mediums or a jam occurs due to the recording mediums being transported in a stacked state.

According to a second aspect of the present invention, the control unit aborts the image forming operation when it is determined that, of the recording medium from the manual feed slot and the recording medium from the stacking unit, a succeeding recording medium is transported to the image forming unit while being stacked on the image forming surface of a preceding recording medium, and the control unit continues the image forming operation when it is determined that the recording mediums are not transported to the image forming unit in the stacked state.

According to the second aspect of the invention, when it is determined that the succeeding recording medium is transported to the image forming unit while being stacked on the image forming surface of the preceding recording medium, the image forming operation is aborted, and when it is determined that the recording mediums are not transported to the image forming unit in a stacked state, the image forming operation is continued. Therefore, when the succeeding recording medium is stacked on the surface opposite to the image forming surface of the preceding recording medium, an image is highly likely to be normally formed on the preceding recording medium. As a result, wasteful consumption of the recording medium can be suppressed, and time and effort required for the restart of the image forming operation can be saved.

According to a third aspect of the present invention, when it is determined that both recording mediums are transported with the preceding recording medium stacked on the image forming surface of the succeeding recording medium, the control unit executes a skew correction operation on the preceding recording medium by using the transport roller if it is determined that skew correction of the preceding recording medium is executable before the succeeding recording medium reaches the transport roller, and aborts the image forming operation if it is determined that skew correction of the preceding recording medium is not executable before the succeeding recording medium reaches the transport roller.

According to the third aspect of the invention, when a recording medium is fed first while being stacked on the image forming surface of another recording medium, if it is determined that the skew correction of the preceding recording medium is executable before the succeeding recording medium reaches the transport roller, the skew correction operation of the preceding recording medium is executed by the transport roller. Therefore, an image can be formed on the preceding recording medium that is transported with the skew movement having been corrected.

According to a fourth aspect of the present invention, the image forming apparatus further comprises: a second detection unit that is provided between the transport roller and the image forming unit to detect a recording medium, wherein, when executing the image forming operation, the control unit determines presence/absence of an error on the basis of whether or not a detection timing of a recording medium by the second detection unit is within a regular range, and when the recording medium from the manual feed slot is transported first while being stacked on the recording medium from the stacking unit, carries out the determination on the basis of a regular range shorter than when the recording medium from the manual feed slot is transported alone.

According to the fourth aspect of the invention, when recording mediums are transported in a stacked state with a recording medium from the manual feed slot having been fed first, it is considered that the transport state of the recording medium is highly likely to become more unstable than usual. For this reason, in such a case, determination conditions become stricter than usual, and it is accurately determined whether or not a recording medium from the manual feed slot normally precedes a recording medium from the stacking unit. Therefore, the occurrence of trouble due to a transport error can be suppressed.

According to a fifth aspect of the invention, the image forming apparatus further comprises: a second detection unit that is provided between the transport roller and the image forming unit to detect a recording medium, wherein, when the preceding recording medium and the succeeding recording medium are transported by the transport roller in a stacked state, if it is determined that a leading end of the succeeding recording medium does not reach the second detection unit when a trailing end of the preceding recording medium has passed through the transport roller, the control unit continues the image forming operation, and stops the transport roller before the leading end of the succeeding recording medium reaches the second detection unit after the trailing end of the preceding recording medium has passed through the transport roller.

According to the fifth aspect of the invention, when the preceding recording medium and the succeeding recording medium are transported to the transport roller in a stacked state, if it is determined that the leading end of the succeeding recording medium does not reach the second detection unit when the trailing end of the preceding recording medium has passed through the transport roller, the image forming operation is continued. Before the leading end of the succeeding recording medium reaches the second detection unit after the trailing end of the preceding recording medium has passed through the transport roller, the transport roller is stopped. Therefore, even if the preceding recording medium and the succeeding recording medium are transported to the transport roller in a stacked state, both recording mediums are separated before the image forming unit, and thus the image forming operation is not stopped. The succeeding recording medium is separated from the preceding recording medium before the second detection unit. As a result, detection of the recording mediums by the second detection unit can be accurately carried out.

According to a sixth aspect of the invention, when executing a next image forming operation, the control unit rotates the transport roller that is in a stopped state, and feeds the succeeding recording medium to the image forming unit.

According to the sixth aspect of the invention, the succeeding recording medium that is separated from the preceding recording medium can be used for the next image forming operation. Therefore, the image forming operation is not stopped, and as a result, the convenience of use can be improved.

According to a seventh aspect of the invention, the first detection unit carries out detection on the basis of the operation of a pivot member that is in pivotable contact with the recording medium, and the first detection unit includes an indicator member that is in conjunction with the pivotal movement of the pivot member to indicate an insertion timing of the recording medium from the manual feed slot.

According to the seventh aspect of the invention, the insertion timing of the recording medium from the manual feed slot is indicated by the indicator member that is in conjunction with the pivot member provided in the first detection unit. Therefore, the recording mediums can be successively inserted from the manual feed slot, and as a result, the image forming operation can be smoothly carried out.

What is claimed is:

1. An image forming apparatus comprising:

an image forming unit configured to form an image on a recording medium;

a transport roller configured to transport a recording medium to the image forming unit;

a stacking unit configured to stack a recording medium;

a manual feed path configured to extend from a manual feed slot to the transport roller;

a feed path configured to extend from the stacking unit to the transport roller;

a feed unit configured to transport the recording medium stacked in the stacking unit to the transport roller through the feed path;

a first detection unit configured to detect a recording medium inserted into the manual feed path from the manual feed slot; and a control unit configured to:

determine whether a succeeding recording medium is stacked on an image forming surface of a preceding recording medium in a case that the first detection unit detects the recording medium inserted into the manual feed path while the recording medium of the stacking unit is in route to the image forming unit;

abort the image forming operation by the image forming unit when the control unit determines that a succeeding recording medium is stacked on an image forming surface of a preceding recording medium;

determine whether a succeeding recording medium is stacked on a surface of the preceding recording medium that is opposite to the image forming surface of the preceding recording medium in a case that the first detection unit detects the recording medium inserted into the manual feed path while the recording medium of the stacking unit is in route to the image forming unit; and continue the image forming operation when the control unit determines that the succeeding recording medium is stacked on a surface of the preceding recording medium that is opposite to the image forming surface of the preceding recording medium.

2. The image forming apparatus according to claim 1, wherein the control unit is further configured to determine whether recording mediums are transported to the image forming unit in a stacked state and to continues the image forming operation when the control unit determines that recording mediums are not transported to the image forming unit in the stacked state.

3. The image forming apparatus according to claim 2, wherein the control unit is further configured to:

determine whether skew correction of the preceding recording medium is executable before the succeeding recording medium reaches the transport roller;

execute a skew correction operation on the preceding recording medium by using the transport roller if the control unit determines that skew correction of the preceding recording medium is executable before the succeeding recording medium reaches the transport roller when the control unit determines that two recording mediums are transported with the preceding recording medium stacked on the image forming surface of the succeeding recording medium; and abort the image forming operation if the control unit determines that skew correction of the preceding recording medium is not executable before the succeeding recording medium reaches the transport roller when the control unit determines that two recording mediums are transported with the preceding recording medium stacked on the image forming surface of the succeeding recording medium.

4. The image forming apparatus according to claim 1, further comprising:

a second detection unit provided between the transport roller and the image forming unit and configured to detect a recording medium, wherein, the control unit is further configured to:

determine whether a leading end of the succeeding recording medium reaches the second detection unit when a trailing end of the preceding recording medium has passed through the transport roller when the preceding recording medium and the succeeding recording medium are transported by the transport roller in a stacked state; and continue the image forming operation and stop the transport roller before the leading end of the succeeding recording medium reaches the second detection unit after the trailing end of the preceding recording medium has passed through the transport roller, if the control unit determines that a leading end of the succeeding recording medium does not reach the second detection unit when a trailing end of the preceding recording medium has passed through the transport roller.

5. The image forming apparatus according to claim 4, wherein, when executing a next image forming operation, the control unit rotates the transport roller that is in a stopped state, and feeds the succeeding recording medium to the image forming unit.

6. The image forming apparatus according to claim 1, wherein the first detection unit carries out detection on the basis of the operation of a pivot member that is in pivotable contact with the recording medium, and wherein the first detection unit includes an indicator member configured to indicate to a user whether the recording medium inserted into the manual feed path is within a detection range of the first detection unit.

7. The image forming apparatus according to claim 6, wherein the indicator member is configured to protrude from the image forming apparatus when the recording medium inserted into the manual feed path is within a detection range of the first detection unit.

8. An image forming apparatus comprising:

an image forming unit configured to form an image on a recording medium;

a transport roller configured to transport a recording medium to the image forming unit;

a stacking unit configured to stack a recording medium;

a manual feed path configured to extend from a manual feed slot to the transport roller;

a feed path configured to extend from the stacking unit to the transport roller;

a feed unit configured to transport the recording medium stacked in the stacking unit to the transport roller through the feed path;

a first detection unit configured to detect a recording medium inserted into the manual feed path from the manual feed slot;

a processor; and memory storing computer-executable instructions that, when executed by the processor, cause the image forming apparatus to:

determine that a succeeding recording medium is in contact with an image forming surface of a preceding recording medium in route to the image forming unit;

abort the image forming operation by the image forming unit when the image forming apparatus determines that a succeeding recording medium is in contact with an image forming surface of a preceding recording medium in route to the image forming unit;

determine that a succeeding recording medium is in contact with a surface of the preceding recording medium that is opposite to the image forming surface of the preceding recording medium in route to the image forming unit; and continue the image forming operation when the image forming apparatus determines that the succeeding recording medium is in contact with a surface of the preceding recording medium that is opposite to the image forming surface of the preceding recording medium in route to the image forming unit.

9. The image forming apparatus according to claim 8, wherein the memory further comprises computer-executable instructions that, when executed by the processor, further cause the image forming apparatus to determine whether recording mediums are transported to the image forming unit in a stacked state and to continue the image forming operation when the image forming apparatus determines that recording mediums are not transported to the image forming unit in the stacked state.

10. The image forming apparatus according to claim 8, wherein the memory further comprises computer-executable instructions that, when executed by the processor, further cause the image forming apparatus to:

determine whether skew correction of the preceding recording medium is executable before the succeeding recording medium reaches the transport roller;

execute a skew correction operation on the preceding recording medium by using the transport roller if the image forming apparatus determines that skew correction of the preceding recording medium is executable before the succeeding recording medium reaches the transport roller when the image forming apparatus determines that two recording mediums are transported with the preceding recording medium in contact with the image forming surface of the succeeding recording medium; and abort the image forming operation if the image forming apparatus determines that skew correction of the preceding recording medium is not executable before the succeeding recording medium reaches the transport roller when the image forming apparatus determines that two recording mediums are transported with the preceding recording medium in contact with the image forming surface of the succeeding recording medium.

11. The image forming apparatus according to claim 8, further comprising:

a second detection unit provided between the transport roller and the image forming unit and configured to detect a recording medium, wherein, the memory further comprises computer-executable instructions that, when executed by the processor, further cause the image forming apparatus to:

determine whether a leading end of the succeeding recording medium reaches the second detection unit when a trailing end of the preceding recording medium has passed through the transport roller when the preceding recording medium and the succeeding recording medium are transported by the transport roller in a stacked state;

continue the image forming operation and stop the transport roller before the leading end of the succeeding recording medium reaches the second detection unit after the trailing end of the preceding recording medium has passed through the transport roller, if the image forming apparatus determines that a leading end of the succeeding recording medium does not reach the second detection unit when a trailing end of the preceding recording medium has passed through the transport roller.

12. The image forming apparatus according to claim 11, wherein, when executing a next image forming operation, the image forming apparatus rotates the transport roller that is in a stopped state, and feeds the succeeding recording medium to the image forming unit.

13. The image forming apparatus according to claim 8, wherein the first detection unit carries out detection on the basis of the operation of a pivot member that is in pivotable contact with the recording medium, and wherein the first detection unit includes an indicator member configured to protrude from the image forming device when the recording medium inserted into the manual feed path is within a detection range of the first detection unit.

* * * * *

UNITED STATES PATENT AND TRADEMARK OFFICE

CERTIFICATE OF CORRECTION

PATENT NO. : 8,238,766 B2
APPLICATION NO. : 12/510317
DATED : August 7, 2012
INVENTOR(S) : Tetsuya Okano It is certified that error appears in the above-identified patent and that said Letters Patent is hereby corrected as shown below:

Column 15, Claim 2, Line 55:
Please delete "to continues the" and replace with --to continue the--

Signed and Sealed this
Second Day of April, 2013

Teresa Stanek Rea
*Acting Director of the United States Patent and Trademark Office*